US006060868A

United States Patent [19]

Mazzorin

[11] Patent Number: 6,060,868

[45] Date of Patent: May 9, 2000

[54] ELECTRONIC SWITCHING CIRCUIT FOR REDUCING POWER-ON SWITCHING TRANSIENTS

[75] Inventor: Giacomo Mazzorin, Milan, Italy

[73] Assignee: Ansaldo Sistemi Industriali S.p.A., Genoa, Italy

[21] Appl. No.: 09/118,646

[22] Filed: Jul. 17, 1998

[30] Foreign Application Priority Data

Jul. 18, 1997 [EP] European Pat. Off. ..... 97830364

[51] Int. Cl.[7] ..... G05F 1/613

[52] U.S. Cl. ..... 323/224; 323/290

[58] Field of Search ..... 323/224, 271, 323/268, 285, 286, 290

[56] References Cited

U.S. PATENT DOCUMENTS 4,538,101 8/1985 Shimpo et al. ..... 323/272
5,568,044 10/1996 Bittner ..... 323/272
5,808,453 9/1998 Lee et al. ..... 323/224

FOREIGN PATENT DOCUMENTS 0 287 525 A2 3/1988 European Pat. Off. .
0 373 712 A2 12/1989 European Pat. Off. .

*Primary Examiner*—Shawn Riley
*Attorney, Agent, or Firm*—Quarles & Brady LLP

[57] ABSTRACT

An electronic switching circuit wherein a first switch has first and second terminals communicating respectively with a supply voltage and with a first terminal of an inductive load; and a second switch has first and second terminals communicating respectively with the first terminal of the load and with a second terminal of the load. A recirculating diode is located parallel with the second switch; the circuit generates a control signal related to the derivative of the recirculating current flowing in the diode; and the control signal is processed to prevent the closing signal from being applied to the first switch when the control signal exceeds a threshold value due to reverse conduction (recovery) of the diode.

13 Claims, 4 Drawing Sheets

Fig.1
Prior Art
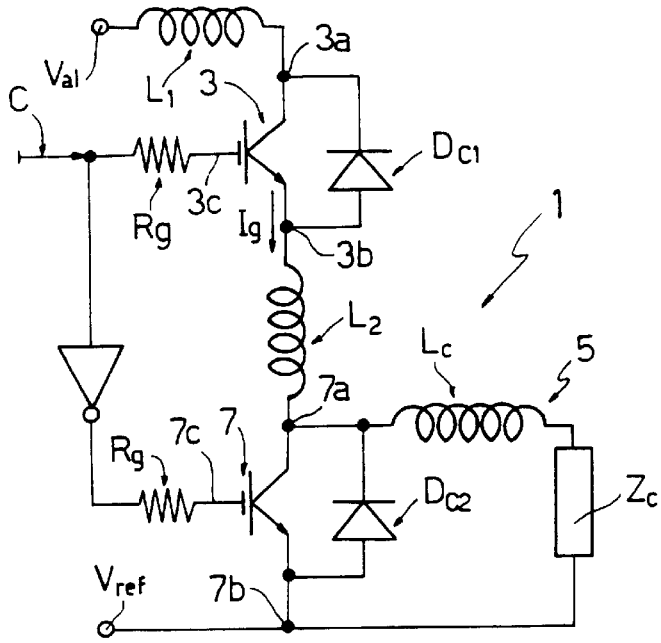
Prior Art
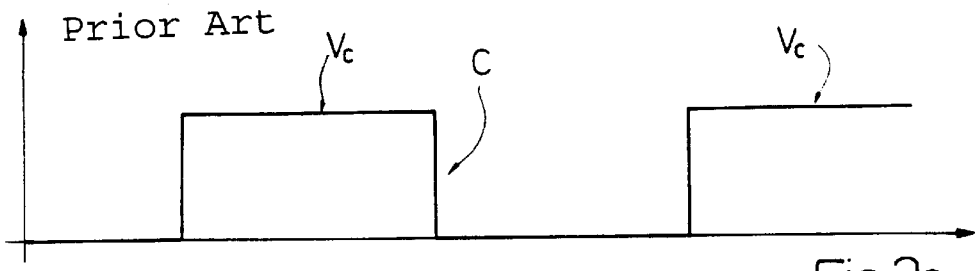
Fig.2a
Prior Art
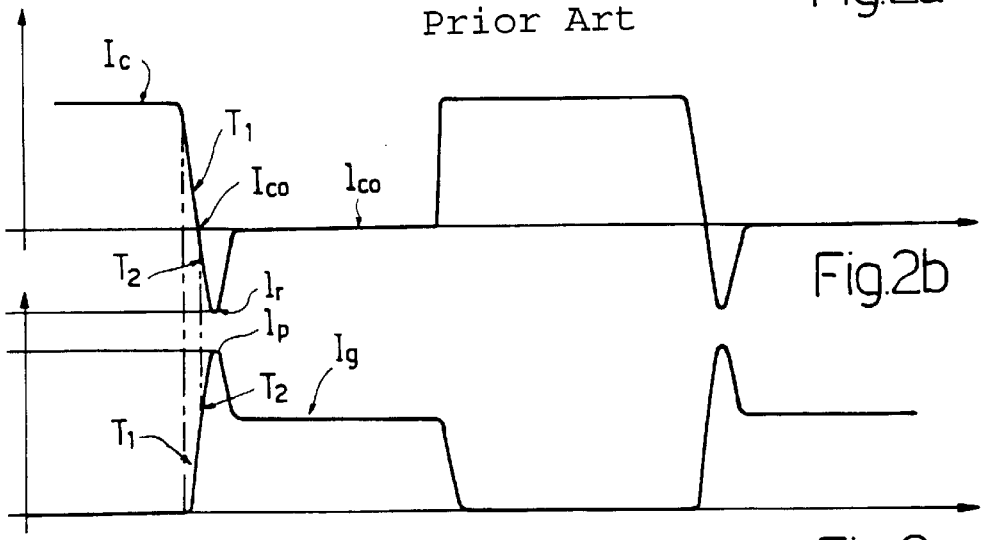
Fig.2b
Fig.2c
Prior Art

ELECTRONIC SWITCHING CIRCUIT FOR REDUCING POWER-ON SWITCHING TRANSIENTS

BACKGROUND OF THE INVENTION

The present invention relates to an electronic switching circuit for reducing power-on switching transients.

Number 1 in FIG. 1 indicates a known electronic switching circuit in which a first solid-state electronic switch 3, e.g. defined by an IGBT transistor, has a first terminal 3*a* connected to a voltage source $V_{al}$ via an inductor $L_1$ a second terminal 3*b* connected via an inductor $L_2$ to a first terminal of a load 5 shown schematically by an inductor Lc and a resistor $Z_c$ connected in series with each other; and a control terminal 3*c* conveniently defined by the gate terminal of the IGBT transistor, and which is supplied via a control resistor $R_g$ with a control signal C. The binary control signal C (FIG. 2*a*) may be defined by a voltage varying between a first logic state (e.g. a zero or negative voltage) corresponding to opening of electronic switch 3, and a second logic state (e.g. a positive voltage $V_c$) corresponding to closing of electronic switch 3; and electronic switch 3 is connected in parallel to a recirculating diode $D_{c1}$ having the cathode connected to terminal 3*a* and the anode connected to terminal 3*b*.

The electronic switching circuit also comprises a second solid-state electronic switch 7 also defined by an IGBT transistor, and which has a first terminal 7*a* connected to the first terminal of load 5; a second terminal 7*b* connected to a reference voltage Vref to which a second terminal of load 5 is also connected; and a control terminal 7*c* supplied via a control resistor Rg with a control signal preferably but not exclusively opposite to control signal C. Electronic switch 7 is also connected in parallel to a recirculating diode $D_{c2}$ having the cathode connected to terminal 7*a* and the anode connected to terminal 7*b*.

The above circuit may conveniently define a CHOPPER for dividing the direct supply voltage Val and supplying load 5 (e.g. comprising an electric motor) with a pulsating voltage; and the CHOPPER circuit may be combined with another of the same type to supply a load with alternating current and so define an INVERTER.

Known electronic switching circuits present a drawback when turned on, due to the physical behaviour of diode $D_{c2}$. That is, when switch 3 is open and switch 7 closed (low logic value of control signal C), the loop defined by load 5 and recirculating diode $D_{c2}$ is supplied with recirculating current by inductor $L_c$ forming part of the loop; and, when switch 3 is closed, diode $D_{c2}$ is reverse biased and should therefore be turned off. In actual fact, however, when switch 3 is turned on, the current Ic supplied by diode $D_{c2}$ decreases substantially steadily to begin with (first portion T1 in FIG. 2*b*), and, on reaching the zero value $I_{co}$ (at which it should stop decreasing if diode $D_{c2}$ were to perform ideally), continues to fall (portion T2) to a negative value $I_r$ from which it then returns to the zero value $I_{co}$, thus creating in diode $D_{c2}$ a negative current peak Ir induced by reverse conduction (recovery) of the diode. As a result, the current $I_g$ supplied by switch 3 and equal to the sum of the load current and current $I_c$ of the diode (FIG. 2*c*) increases substantially steadily at portion T1, and, on reaching the steady-state value (at which it should stop increasing if diode $D_{c2}$ were to perform ideally), continues rising (portion T2) up to a positive value $I_p$ from which it then falls back to the steady-state value, thus creating in switch 3 a positive current peak $I_p$ induced by reverse conduction of diode $D_{c2}$.

Diode recovery is a well known phenomenon which has always been considered uncontrollable, and which, on account of the current peak Ir applied to diode $D_{c2}$ and the normally high supply voltages of such electronic circuits, results in the generation of extremely high instantaneous power capable of destroying the diode. For example, supply voltages of thousands of volts (e.g. 2000 V) may result in recovery currents of about a thousand amperes (e.g. 1500 A) and an instantaneous power of several megawatts (e.g. 3 MW) which no diode on the market could withstand. Similarly, the high current supplied by switch 3 may either damage the switch itself or at least cause it to operate, albeit for a few instants, outside the safety range.

The known solution to the above drawbacks is to prolong the turn-on time of electronic switch 3 to gradually reduce the current in diode $D_{c2}$ and so achieve lower recovery current values by selecting a sufficiently high resistance of resistor $R_g$. Electronic switch manufacturers, in fact, specify a minimum resistance of resistor $R_g$ for safeguarding against the recovery phenomenon. Prolonging the turn-on time of electronic switches, however, clearly results in a drastic increase in the amount of energy dissipated each time the circuit switches.

SUMMARY OF THE INVENTION

It is an object of the present invention to provide a switching circuit of the above type, designed to solve the recovery phenomenon with a minimum increase in the amount of energy dissipated by switching of the circuit.

According to the present invention, there is provided an electronic switching circuit for reducing power-on switching transients.

The present invention also relates to a method of controlling an electronic switching circuit.

BRIEF DESCRIPTION OF THE DRAWINGS

A non-limiting embodiment of the present invention will be described by way of example with reference to the accompanying drawings, in which:

FIG. 1 shows a known solid-state electronic switching circuit;

FIGS. 2*a*, 2*b*, 2*c* show waveforms of quantities relative to the FIG. 1 circuit;

DETAILED DESCRIPTION OF THE INVENTION

Figure 3:
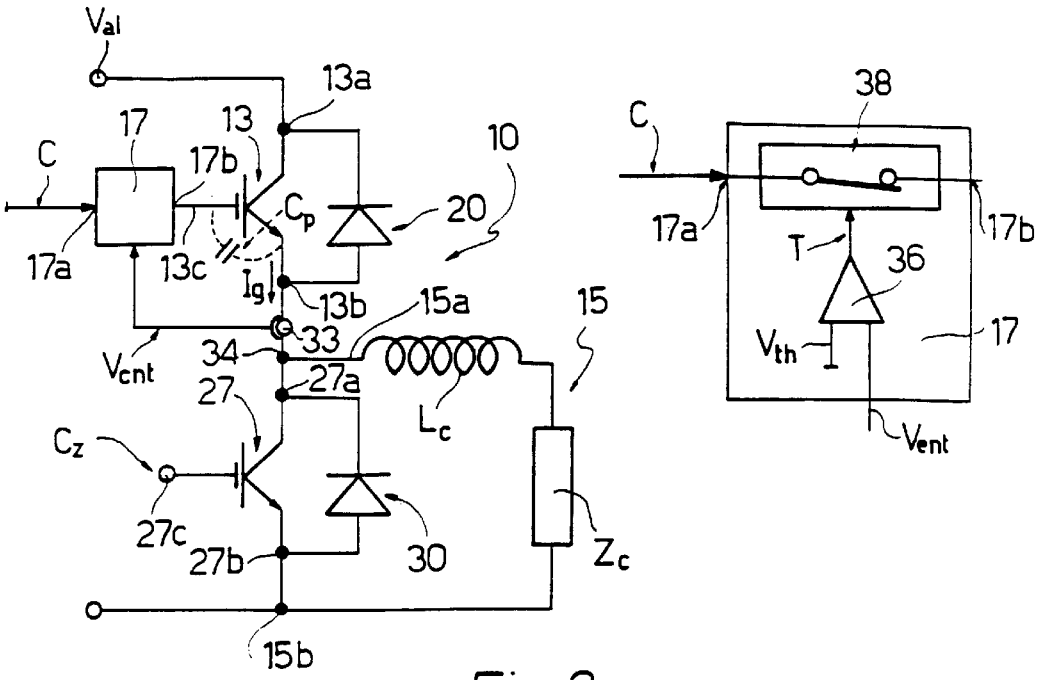
FIG. 3 shows a solid-state electronic switching circuit for reducing power-on switching transients in accordance with the teachings of the present invention.

With reference to FIG. 3, number 10 indicates an electronic switching circuit wherein a first solid-state electronic switch 13, e.g. defined by an IGBT transistor, has a first terminal (collector terminal) 13*a* connected to a direct voltage source $V_{al}$; a second terminal (emitter terminal) 13*b* communicating with a first terminal 15*a* of a load 15 (e.g. a direct-current electric motor) shown schematically by an inductor $L_c$ and a resistor Zc connected in series to each other; and a control terminal 13*c* conveniently defined by the gate terminal of the IGBT transistor, and which is supplied via an active control circuit 17 with a control signal C. More specifically, active control circuit 17 comprises an input 17*a* supplied directly with control signal C; and an output 17*b* connected to control terminal 13*c*.

Figure 4A:
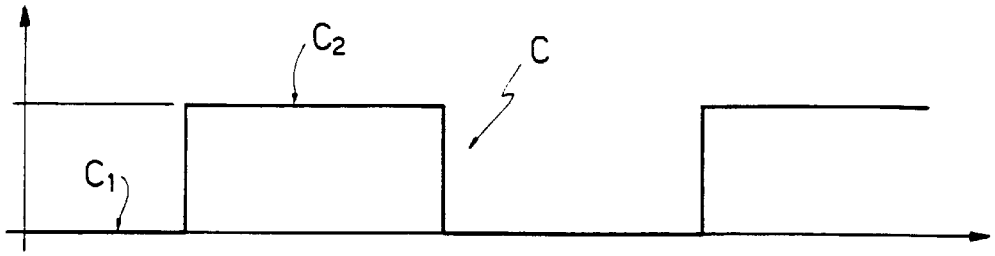
FIGS. 4*a*, 4*b*, 4*c* show waveforms of quantities relative to the FIG. 3 circuit.

The binary control signal C (FIG. 4*a*) is conveniently defined by a voltage varying between a first value $C_1$ (e.g. −15 V) corresponding to opening of electronic switch 13, and a second value $C_2$ (e.g. +15 V) for closing electronic switch 13; and electronic switch 13 is connected in parallel to a recirculating diode 20 having the cathode connected to terminal 13*a* and the anode connected to terminal 13*b*.

Electronic switching circuit 10 also comprises a second solid-state electronic switch 27 also defined by an IGBT transistor, and which has a first terminal 27*a* (collector terminal of the IGBT transistor) communicating with terminal 13*b*, and a second terminal 27*b* (emitter terminal of the IGBT transistor) connected to a reference voltage to which a second terminal 15*b* of load 15 is also connected.

Electronic switch 27 is also connected in parallel to a recirculating diode 30 having the cathode connected to terminal 27*a* and the anode connected to terminal 27*b*.

Second switch 27 also comprises a control terminal 27*c* (gate terminal of the IGBT transistor) supplied with a second control signal Cz, which may be correlated to control signal C. In the above CHOPPER configuration, signal Cs is always in the block state, i.e. switch 27 is always open and only recirculating diode 30 is operative.

According to the present invention, circuit 10 comprises a current transducer 33 interposed between terminal 13*b* and a node 34 to which terminal 27*a* of second switch 27 and first terminal 15*a* of load 15 are connected.

The current $I_g$ flowing in switch 13 during closure of the switch, and which, as stated, equals the current flow in load 15 plus the recovery current $I_c$ of diode 30 (FIG. 2*c*), flows through current transducer 33, which generates a control signal $V_{cnt}$ proportional to the derivative of current $I_g$, i.e.:

$$V_{cnt} = \frac{d(I_g)}{dt}$$

Figure 4B:
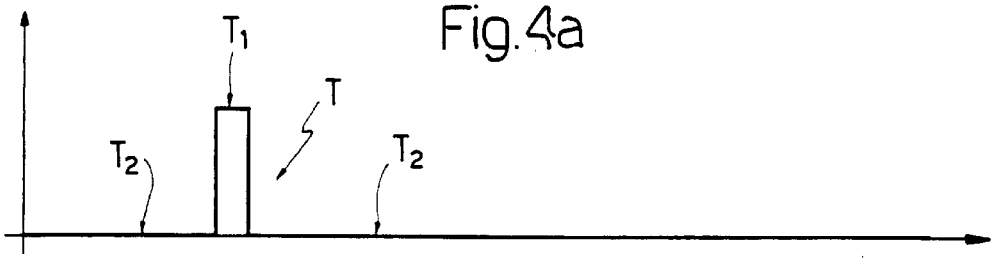

Control signal $V_{cnt}$ is conveniently supplied to control circuit 17 in which it is compared by a comparator 36 with a threshold value Vth to generate a binary output signal T (FIG. 4*b*) assuming a first and a second logic state T1, T2 when control signal $V_{cnt}$ is respectively above and below threshold value $V_{th}$. Control circuit 17 also comprises a power-on control device 38 (shown schematically by a switch) interposed between input 17*a* and output 17*b* and controlled by binary signal T. When binary signal T assumes second logic state T2, i.e. when the derivative of current $I_g$ is below threshold $V_{th}$, power-on control device 38 (switch 38 closed) allows control signal C controlling closure of switch 13 to be transferred through device 17 to the gate of the IGBT transistor. Conversely, when binary signal T assumes first logic state T1, i.e. when the derivative of current $I_g$ is above threshold Vth, power-on control device 38 (switch 38 open) prevents control signal C controlling closure of switch 13 from being applied to the gate of the IGBT transistor, and so prevents switch 13 from being turned on.

Figure 4C:
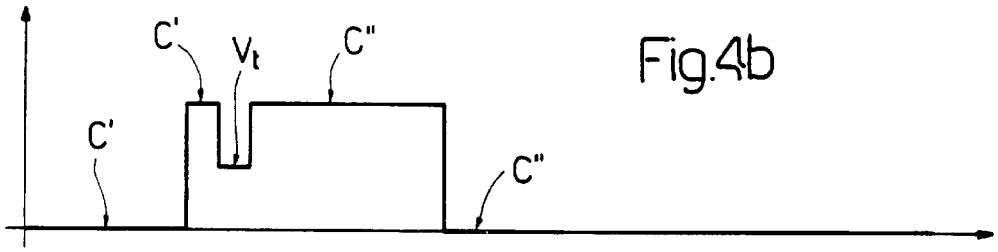

In actual use, under normal operating conditions, i.e. when the derivative of current $I_g$ is below threshold value $V_{th}$, control signal C applied to input 17*a* is transferred to output 17*b* and contributes in known manner towards controlling electronic switch 13 (portion C' of the control signal shown in FIG. 4*c*). More specifically, IGBT transistor 13 is kept open for values $C_1$ and is closed for values $C_2$ of control signal C. When IGBT transistor 13 is closed, the recirculating current Ic flowing in diode 30 decreases rapidly and, due to the recovery phenomenon mentioned above, tends towards negative value $I_r$; and the rapid variation in recirculating current Ic produces a rapid increase in current $I_g$ across switch 13. The increase in current $I_g$, however, is detected by transducer 33, which, as stated, generates a control signal $V_{cnt}$ indicating the variation in time of the current across switch 13. When the derivative of current $I_g$ is above threshold value Vth, i.e. when current Ic falls too rapidly on account of the recovery phenomenon, the control signal is prevented (switch 38 open) from being transferred to transistor 13, and the previous control signal controlling closure of transistor 13 is removed, so that IGBT transistor 13 passes from a "hard" power-on state, i.e. with a high current derivative (switch 13 closing rapidly), to a "soft" power-on state, i.e. with a much lower current derivative, to prevent any further reduction in the recirculating current. IGBT transistors, in fact, are known to comprise, between the gate and emitter terminals, a parasitic capacitance $C_p$ high enough, when charged, to maintain the GATE potential at a sufficiently high positive value $V_t$ even when no control signal is applied to the GATE. As such, when control signal C to the gate of transistor 13 is removed, the gate nevertheless remains biased at voltage $V_t$ by the parasitic capacitance, but the IGBT transistor is no longer saturated and operates in the linear zone.

The recirculating current may therefore return to lower absolute values, and, when the derivative of current $I_g$ also falls below the threshold value, closure of switch 13 is once again enabled (control signal C") and the switch may once more be closed is so controlled by control signal C.

Figure 5:
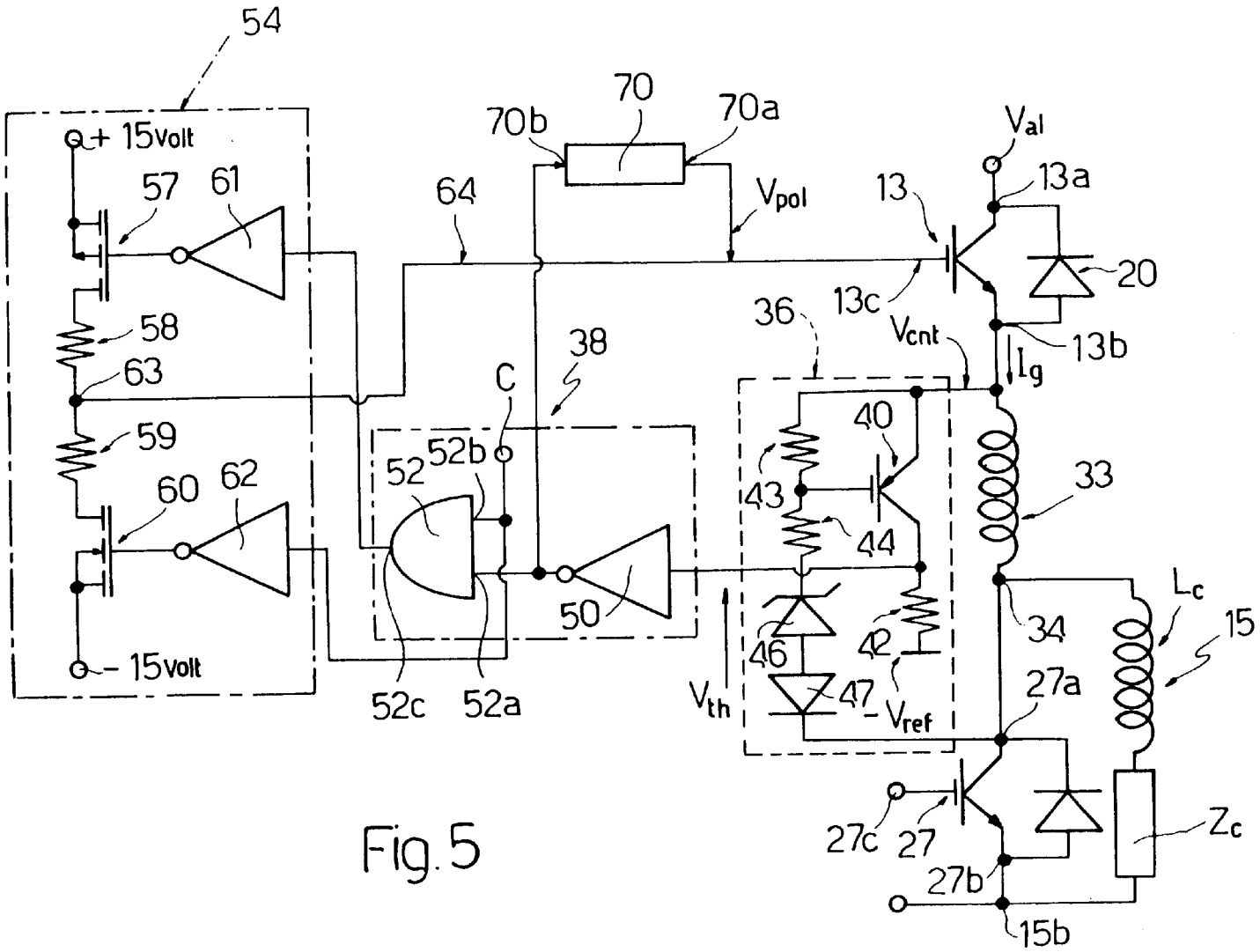
FIG. 5 shows a detailed portion of the FIG. 3 circuit.

FIG. 5 shows an actual physical embodiment of the circuit shown schematically in FIG. 3.

In the example shown, current transducer 33 for generating an output signal proportional to the derivative of current $I_g$ across transducer 33 is defined by a straightforward inductor interposed between terminal 13*b* and node 34, and the voltage Vcnt at the terminals of which is known to be given by the following equation:

$$V_{cnt} = L\frac{d(I_g)}{dt}$$

where Ig is the current across the inductor, and L the inductance of inductor 33.

Inductor 33 is conveniently defined by the parasitic inductance in the physical IGBT component between the control return terminal (auxiliary emitter—13*b*) and the power terminal (power emitter—node 34). The physical IGBT transistor, in fact, is known to comprise a casing with four connection terminals respectively corresponding to the collector terminal (13*a*), the control (GATE) terminal (13*c*), the control return terminal (auxiliary emitter—13*b*) connected directly to the emitter region of the CHIP defining the IGBT transistor, and the power terminal (power emitter—node 34) through which the IGBT transistor current flows.

Comparator 36 in turn comprises a PNP transistor 40 with the emitter connected to auxiliary emitter 13*b*, and the collector connected via a resistor 42 to a negative reference voltage $V_{ref}$ (e.g. −15 V); a resistor 43 interposed between the emitter and base of transistor 40; and a resistor 44 having a first terminal connected to the base of transistor 40, and a second terminal to which is applied a reference voltage $V_{th}$ conveniently defined by the voltage drop at the terminals of a Zener diode 46 and a diode 47 connected in series with each other and interposed between the base of transistor 40 and node 34. Conveniently, the cathode of Zener diode 46 is connected to resistor 44, and the cathode of diode 47 is connected to node 34. The output of comparator 36 is defined by the collector of transistor 40, to which is connected the input of an inverting circuit 50 forming part of power-on control device 38, which also comprises an AND gate 52 having a first input 52*a* communicating with the output of inverting circuit 50, a second input 52*b* supplied with control signal C, and an output 52*c* communicating, via a level shift circuit 54, with control terminal 13*c* of electronic switch 13.

Level shift circuit 54 comprises an inverting level shifter 61 having an input connected to output 52*c* of AND gate 52, and an output connected to the gate of a first P-channel MOSFET transistor 57, which has the source terminal connected to a positive direct voltage source (+15 V), and the drain terminal connected to a first terminal of a resistor 58, the second terminal of which is connected to a first terminal of a resistor 59. Resistor 59 has a second terminal connected to the source terminal of an N-channel MOSFET transistor 60, the drain terminal of which is connected to a negative direct voltage source (−15 V). Inverting level shifter 61 provides for converting a −15 V input voltage (logic 0) into a +15 V output voltage, and for converting a zero volt input voltage (logic 1) into a zero volt output voltage. Active control circuit 17 also comprises an inverting circuit 62 having an input receiving control signal C, and an output connected to the GATE terminal of transistor 60. Node 63 connecting resistors 58 and 59 defines the output of level shift circuit 54, which is connected to control terminal 13*c* over an electric line 64.

Figure 6A:
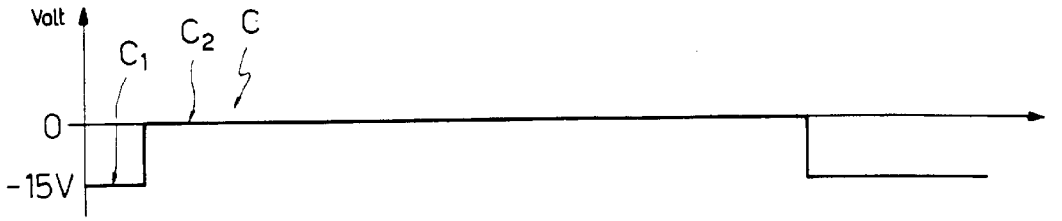
FIGS. 6*a*–6*f* show waveforms of quantities relative to the FIG. 5 circuit.
Figure 6B:
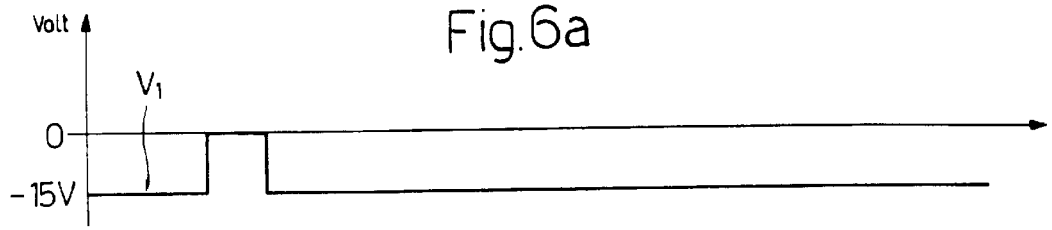
Figure 6C:
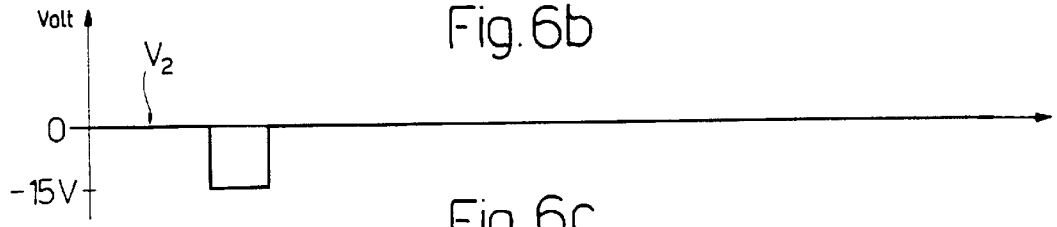
Figure 6D:
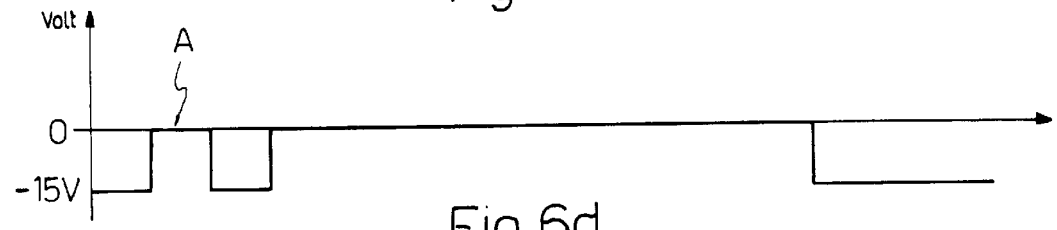
Figure 6E:
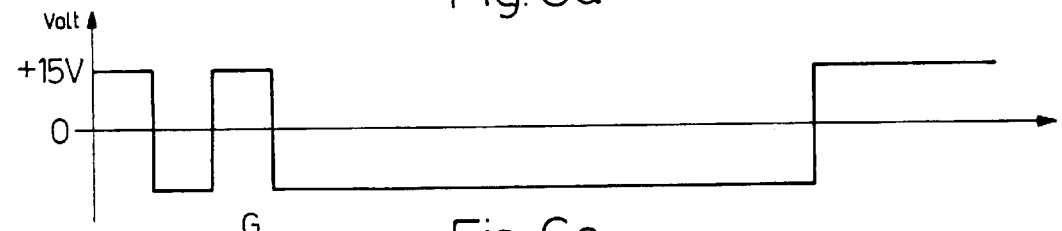
Figure 6F:
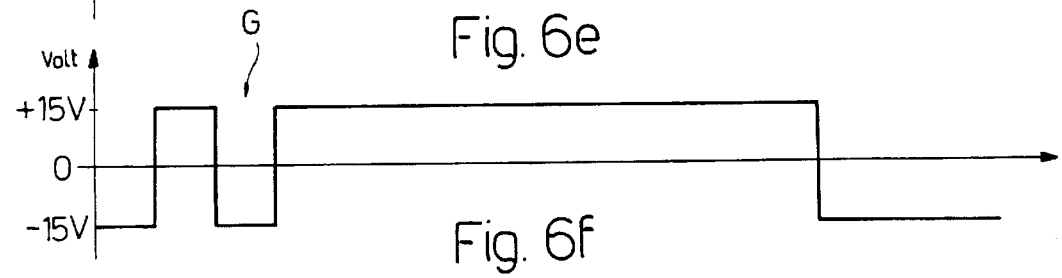

In actual use, under normal operating conditions, i.e. when voltage Vcnt of inductor 33 is lower than voltage Vth, transistor 40 is reverse biased and does not conduct, so that the voltage V1 at the collector of transistor 40 equals −15 V, equivalent to a logic 0 (FIG. 6*b*). The logic 0 (−15 V) applied to the input of inverting circuit 50 is then converted into a signal V2 (FIG. 6*c*) representing a logic 1 (of a conventional value, say, of 0 V) applied to input 52*a* of AND gate 52, which generates an output signal A (FIG. 6*d*) representing a logic state equal to the product of the logic 1 state multiplied by the logic state applied to input 52*b*. More specifically, if signal C (FIG. 6*a*) assumes a logic value $C_2$ equal to a logic 1 (conveniently equal to 0 V), output A of gate 52 also assumes a logic 1 value; and, if signal C assumes a logic value $C_1$ equal to a "logic 0" (conveniently equal to −15 V), the output of gate 52 also assumes a "logic 0" value. The "logic 1" at the output of gate 52 is converted by shift circuit 54 into a +15 V signal G (FIG. 6*f*) for closing IGBT transistor 13, and the "logic 0" at the output of gate 52 is converted by shift circuit 54 into an open-circuit condition of IGBT transistor 13.

In fact, with a "logic 1" (0 V) at the input of inverting level shifter 61, the output of inverting level shifter 61 equals 0 V, transistor 57 is conductive, and node 63 is supplied with a voltage of +15 V, which, applied to gate 13*c*, saturates and turns on IGBT transistor 13. In which case, a "logic 1" is supplied to the input of inverting circuit 62, which produces an output voltage of −15 V (equivalent to a "logic 0") to disable transistor 60.

With a "logic 0" (−15 V) at the input of inverting level shifter 61, the output of inverting level shifter 61 equals +15 V, which, applied to transistor 57, disables transistor 57 so that the "logic 0" applied to the input of circuit 62 forces the output of circuit 62 to a voltage value (0 V) equivalent to a "logic 1" applied to the gate of transistor 60, which so conducts that the −15 V voltage is applied to gate 13*c* to disable and turn off IGBT transistor 13.

Under normal operating conditions, therefore, switch 13 is closed by a logic 1 and opened by a logic 0 of signal C.

The diode recovery phenomenon causes the voltage Vcnt of inductor 33 to exceed voltage Vth, so that transistor 40 is biased directly and made conductive, and the voltage at the collector of transistor 40 equals 0 V, equivalent to a "logic 1". The "logic 1" (0 V) applied to the input of inverting circuit 50 is then converted into a logic 0 (−15 V) applied to input 52*a* of AND gate 52, which generates an output signal of a logic state equal to the product of input 52*b* multiplied by the "logic 0" state. More specifically, the output of AND gate 52 is always at "logic 0" regardless of whether signal C assumes a "logic 1" (0 V) or a "logic 0" (−15 V), and the logic 0 present at all times at the output of gate 52 is converted by inverting level shifter 61 into a +15 V signal applied to MOSFET transistor 57, which opens, leaving gate terminal 58 floating, so that transistor 13 cannot be closed. In which case, if control signal C assumes a "logic 1", the output of circuit 62 assumes a logic 0 (−15 V) and transistor 60 is nonconductive; if control signal C assumes a logic 0, the output of circuit 62 assumes a "logic 1" (0 V), and transistor 60 conducts to supply gate 13*c* with a negative −15 V voltage, so that transistor 13 may nevertheless be opened.

In other words, a "logic 0" at the output of circuit 50 prevents transistor 13 from being turned on by preventing transfer of control signal C from input 17*a* to control terminal 13*c*, but allows the transistor to be turned off.

The advantages of the present invention will be clear from the foregoing description. In particular, active control circuit 17 provides, fully automatically and by means of a highly straightforward circuit, for preventing application of the closing signal to switch 13 whenever the current in recirculating diode 30 moves rapidly towards "critical" values immediately interrupting the increase (towards negative values) of the diode current when switch 13 is set to the linear operating region.

Together with inverting circuit 50, comparator 36 in fact alternately generates a disabling signal (signal V2=logic 0) when control signal Vcnt exceeds threshold Vth, and an enabling signal (signal V2=logic 1) when control signal $V_{cnt}$ is below threshold $V_{th}$.

Upon safe operating conditions being restored, i.e. when the recirculating current stops increasing, the conditions previous to the transient state caused by recovery of the diode are restored, and switch 13 may once more be closed by signal C. In the presence of the enabling signal (V2=logic 1), power-on control device 38 in fact provides for enabling control of first switch 13 by control signal C.

Clearly, changes may be made to the electronic circuit as described and illustrated herein without, however, departing from the scope of the present invention.

Circuit 10 may also comprise (FIG. 5) a biasing circuit 70 having an output 70*a* communicating with control terminal 13*c*, and an enabling input 70*b* communicating with the output of inverting circuit 50; which circuit 70 is activated by a logic 0 at the output of circuit 50 (i.e. during recovery of the diode) and supplies control terminal 13*c* with a given potential Vpol to set IGBT transistor 13 to an optimum linear operating region.

I claim:

1. An electronic switching circuit (10) for reducing power-on switching transients, the circuit (10) comprising:

first electronic switching means (13) having first and second terminals (13*a*, 13*b*) communicating respectively with a supply voltage ($V_{al}$) and a first terminal (15*a*) of a load (15), in particular a load comprising at least one inductive component ($L_c$);

said first electronic switching means (13) having at least one control terminal (13*c*) controlled by a command signal (C) for alternately opening or closing said first switching means (13);

second electronic switching means (27) having first and second terminals (27*a*, 27*b*) communicating respectively with said first terminal (15*a*) of said load and with a second terminal (15*b*) of the load; and recirculating diode means (30) located parallel with said second switching means (27);

transducing means (33) cooperating with said recirculating diode means (30) and for generating a control signal ($V_{cnt}$) related to the rate of change of the current flowing in said recirculating diode means (30); and active control means (17) interposed between a receiving input (17*a*) supplied with said command signal (C), and said control terminal (13*c*) of said first electronic switching means (13); said active control means (17) also receiving said control signal ($V_{cnt}$) to at least prevent said command signal (C) from being transferred to said control terminal (13*c*) of said first electronic switching means (13) to close the first switching means, when said control signal ($V_{cnt}$) assumes a predetermined relationship with respect to at least one threshold value ($V_{th}$).

2. A circuit as claimed in claim 1, wherein said switching means further comprises transistor means, in particular IGBT transistors;

wherein said active control means (17) further comprise biasing means (70) which, upon said control signal ($V_{cnt}$) assuming said predetermined relationship, supply said control terminal (13*c*) of said first switching means (13) with a given potential ($V_{pol}$) for setting said transistor means (13) to a linear operating region.

3. A circuit as claimed in claim 1, wherein said transducing means (33) are located in series with said first switching means (13).

4. A circuit as claimed in claim 1, wherein said transducing means (33) comprise inductor means; said control signal ($V_{cnt}$) being defined by the voltage across said inductor means (33).

5. A circuit as claimed in claim 1, wherein said active control means (17) further comprise:

comparing means (36) for comparing the control signal ($V_{cnt}$) with said threshold value, and generating a disabling signal (T2, V2) when said control signal ($V_{cnt}$) conforms with said predetermined relationship with respect to said threshold value ($V_{th}$); said comparing means (36) otherwise generating an enabling signal (ˆT2, V2); and power-on control switching means (38) cooperating with said comparing means (36) and interposed between said control terminal and said receiving input; said power-on control switching means (38) being set, in the presence of said disabling signal (T2, V2), to an open state to prevent said command signal (C) from being transferred to said control terminal (13*c*) to close said first switching means (13);

said power-on control switching means (38) also being set, in the presence of said enabling signal (T2, V2), to a closed state to control said first switching means (13) by means of said command signal (C).

6. A circuit as claimed in claim 5, wherein said power-on control switching means comprise:

logic multiplying means (52) having a first input (52*b*) supplied with said command signal (C) varying between a first logic state to open said first switching means (13), and a second logic state to close said first switching means (13); said logic multiplying means (52) also having a second input (52*a*) communicating with the output of said comparing means (36) to alternately receive said disabling signal (V2) or said enabling signal (V2); said disabling signal representing a "logic 0" state, in the presence of which said multiplying means generate a deenergizing signal for disabling closure of said first switching means (13).

7. A circuit as claimed in claim 6, further comprising level shifting means (54) interposed between said logic multiplying means (52) and said control terminal (13*c*), and for converting said deenergizing signal into a potential, in particular a floating potential, which is applied to said control terminal (13*c*) of said first electronic switching means to disable closure of said first switching means (13).

8. A circuit as claimed in claim 6, further comprising converting means (62) located parallel with said logic multiplying means (52), and which receive said control signal and convert said first logic state (0) of said command signal (C) into a command to open said first switching means (13).

9. A circuit as claimed in claim 1, wherein said first electronic switching means comprise transistor means.

10. A circuit as claimed in claim 1, wherein said first electronic switching means comprise an IGBT transistor.

11. A method of controlling an electronic switching circuit (10) comprising:

first electronic switching means (13) having first and second terminals (13*a*, 13*b*) communicating respectively with a supply voltage ($V_{al}$) and a first terminal (15*a*) of a load (15), in particular a load comprising at least one inductive component ($L_c$);

said first electronic switching means (13) having at least one control terminal (13*c*) controlled by a command signal (C) for alternately opening or closing said first switching means (13);

second electronic switching means (27) having first and second terminals (27*a*, 27*b*) communicating respectively with said first terminal (15*a*) of said load and with a second terminal (15*b*) of the load; and recirculating diode means (30) located parallel with said second switching means (27);

characterized by the steps of:

conducting current through said recirculating diode means (30) as a result of the first switching means (13) being closed and the second switching means (27) being opened;

generating a control signal ($V_{cnt}$) related to the rate of change of the current flowing in said recirculating diode means (30); and processing said control signal ($V_{cnt}$) to prevent said command signal (C) from being applied to said first electronic switching means (13) to close the first switching means, when said control signal ($V_{cnt}$) assumes a predetermined relationship with respect to at least one threshold value ($V_{th}$).

12. A method as claimed in claim 11, wherein said processing step further comprises the substeps of:

comparing (36) the control signal ($V_{cnt}$) with said threshold value to generate a disabling signal (T2, V2) when said control signal ($V_{cnt}$) conforms with said predetermined relationship with respect to said threshold value ($V_{th}$), and to otherwise generate an enabling signal (V2);

preventing said command signal (C) for closing said first electronic switching means (13) from being transferred, in the presence of said disabling signal (V2), to said control terminal (13*c*) of said first electronic switching means (13); and controlling said first switching means (13) by means of said command signal (C) in the presence of said enabling signal (V2).

13. A method as claimed in claim 12, wherein said command signal (C) varies between a first logic state to open said first switching means (13), and a second logic state to close said first switching means (13);

wherein said processing step also comprises the step of:

determining the logic product of said command signal (C) alternately multiplied by said disabling signal or said enabling signal; said disabling signal having a "logic 0" state to generate, by means of said multiplication, a deenergizing signal for disabling closure of said first switching means (13).

* * * * *